US005323840A

United States Patent [19]

Usui et al.

[11] Patent Number: 5,323,840

[45] Date of Patent: Jun. 28, 1994

[54] METAL MOLD ARRANGEMENT FOR CASTING WATER-COOLED TYPE CYLINDER BLOCK IN HORIZONTAL TYPE CASTING MACHINE

[75] Inventors: Hirotake Usui, Tokyo; Yoshiaki Egoshi; Joji Umeda, both of Fuchu; Toru Komazaki, Tokyo, all of Japan

[73] Assignee: Ryobi Ltd., Hiroshima, Japan

[21] Appl. No.: 111,952

[22] Filed: Aug. 26, 1993

[30] Foreign Application Priority Data

Aug. 28, 1992 [JP] Japan ..... 4-254098

[51] Int. Cl.[5] ..... B22D 17/10; B22D 17/24; B22D 19/02

[52] U.S. Cl. ..... 164/332; 164/312; 164/333; 164/340

[58] Field of Search ..... 164/312, 332, 333, 340, 164/342

[56] References Cited

U.S. PATENT DOCUMENTS

| | | | |
|---|---|---|---|
| 4,727,923 | 3/1988 | Ebisawa et al. | 164/312 X |
| 4,738,298 | 4/1988 | Taruno et al. | 164/312 X |
| 4,880,048 | 11/1989 | Gaulard | 164/342 |
| 5,121,786 | 6/1992 | Kawase et al. | 164/98 |

FOREIGN PATENT DOCUMENTS

| | | | |
|---|---|---|---|
| 0465947 | 1/1992 | European Pat. Off. . | |
| 61-150746 | 7/1986 | Japan | 164/342 |
| 62-81247 | 4/1987 | Japan | 164/340 |
| 62-84857 | 4/1987 | Japan | 164/340 |
| 63-72461 | 4/1988 | Japan | 164/312 |
| WO91/00787 | 1/1991 | PCT Int'l Appl. . | |
| 883441 | 11/1961 | United Kingdom . | |

OTHER PUBLICATIONS

Patent Abstract of Japan, unexamined applications, M section, vol. 13, No. 458, Oct. 17, 1989.

Abstract of Japanese Patent Publication 1-178361 published Jul. 14, 1989.

*Primary Examiner*—J. Reed Batten, Jr.

*Attorney, Agent, or Firm*—Sughrue, Mion, Zinn, Macpeak & Seas

[57] ABSTRACT

The horizontal type casting machine is capable of facilitating installation of a water jacket core and providing sufficient fluidity of the molten metal without generation of gas defect in casting a water-cooled type cylinder block. In the horizontal type casting machine, a cavity for the cylinder block is oriented vertically in which a cylinder bore portion of the cylinder block is positioned up and a crank chamber is positioned down. The cavity is defined by a stationary die, a movable die and movable cores. A movable slide core is provided movable relative to the movable die. When the movable slide core is moved to its retracted position, large working space is provided for installing the water jacket core at a given position. By the retracted movement of the movable slide core, large working space can be provided, thereby facilitating installation of the water jacket core. Further, since the water jacket core is set in its suspended fashion, easy positioning of the water jacket core results.

15 Claims, 8 Drawing Sheets

METAL MOLD ARRANGEMENT FOR CASTING WATER-COOLED TYPE CYLINDER BLOCK IN HORIZONTAL TYPE CASTING MACHINE

BACKGROUND OF THE INVENTION

The present invention relates to a metal mold arrangement for casting a cylinder block of a water-cooled engine, and more particularly, to a type thereof used in a horizontal type casting machine where the cylinder block can be molded in its vertical orientation with a cylinder bore portion surrounded by a water jacket being positioned up and a crank chamber being positioned down during casting. Throughout the specification, the "horizontal type casting machine" implies the machine where a casting sleeve and a mold cavity are positioned on the horizontal plane.

Japanese Patent Application Kokai No. Hei 1-178361 discloses a method and apparatus for casting a cylinder block having a water jacket for use in a water-cooled type internal combustion engine. The disclosed invention uses a horizontal type casting machine where a metal mold is disposed so that the cylinder block extends horizontally. That is, as shown in FIG. 8, a stationary die 103 is fixed to a stationary platen 1, and a movable die 104 fixed to a movable platen 2 through a die base 14 is disposed in confronting relation to the stationary die 103.

In the stationary die 103, a stationary die 105 extends toward the movable die 104 for supporting a cast iron sleeve 23 which serves as a cylinder liner and for defining a crank chamber. That is, the stationary die 105 is provided so that a resultant cylinder block extends horizontally. To this effect, a bore pin 129 which defines a cylinder bore integrally protrudes horizontally from the stationary die 105. The cast iron sleeve 23 is disposed over an outer peripheral surface of the bore pin 129. The stationary die 105 has a gate 105*a* in communication with a casting sleeve 19 which extends through a stationary platen 1 and the stationary mold 105. A bushing 20 is disposed over a portion of the casting sleeve 20, the portion being positioned at a side of the stationary die 105. A plunger chip 21 is slidably disposed in the casting sleeve 19.

A movable die 106 is disposed in the movable die 104. An ejector pin 118' and a water jacket core support pin 118 extend through and are movable relative to the movable die 106. One end of the ejector pin 118' is fixed to an ejector plate 15 movable along a pair of guide rods 16 extending in a die base 14. The ejector plate 15 is connected to a push rod 17 driven by a driving means not shown. Thus, in accordance with the movement of the ejector plate 15 along the guide rods 16 because of the movement of the push rod 17, the ejector pin 118' extends through the movable die 106 and protrudes toward the stationary die 103. Consequently, casted product can be removed from the metal mold. One end of the core support pin 118 is connected to a driving mechanism 118A. Because of the operation of the driving mechanism 118A, the core support pin 118 moves in an axial direction thereof.

An upwardly movable core 108 and a downwardly movable core 109 are movably disposed between the stationary die 103 and the movable die 104 for surrounding the stationary die 105 and the bore pin 129. Thus, a cavity is provided by a space defined by the stationary die 105, the bore pin 129, the upwardly movable core 108, the downwardly movable core 109 and the movable die 106.

Within the cavity, a water jacket core 122 is disposed concentrically around the cast iron sleeve 23 supported by the bore pin 129. A projection 122*a* radially outwardly extends from an outer peripheral surface of the water jacket core 122, and an upper surface of the downwardly movable core 109 is formed with a recess 109*a* at a position engageable with the projection 122*a*. Further, a lower surface of the upwardly movable core 108 is formed with an abutment face 108*a* abuttable on the water jacket core 122. The water jacket core 122 is held at a predetermined position in the cavity by the abutment between the abutment face 108*a* and the water jacket core 122 and the engagement between the recess 109*a* and the projection 122*a*.

The water jacket core supporting pin 118 has a free end extendible into and retractable from the cavity so as to temporarily hold the water jacket core 122 at a predetermined position up to the closure of the metal molds. For example, in case of a four cylinder in line engine shown in FIG. 9, the water jacket core supporting pin 118 is moved to extend from the movable die 106, so that the free ends of the pins 118 are positioned immediately below joining portions 122*b* of neighboring cylinders.

To be more specific, while the metal molds is open, the cast iron sleeve 23 is disposed around the bore pin 129 of the stationary die 105. Then, the driving mechanism 118A is operated so as to extend the water jacket core supporting pin 118 toward the stationary die, so that the water jacket core 122 is mounted on the free end of the pin 118. Next, the upwardly movable core 108 is moved to its descent position, and the downwardly movable core 109 is moved to its ascent position. Thus, the projection 122*a* of the water jacket core and the recess 109*a* are engaged with each other, and the abutment face 108*a* is brought into abutment with the water jacket core 122. Thus, the water jacket core 122 is fixed at a position.

Then, the movable die 104 is moved toward the stationary die 103 for closing the metal molds. The water jacket core 122 is thus disposed around the outer periphery of the sleeve 23. The mold closure provides a cavity for casting a cylinder block. Consequently, a water-cooled type cylinder block having a water jacket is produced by filling molten metal into the cavity by way of the injection sleeve 19.

In the above described conventional casting apparatus, the water jacket core 122 is temporarily held by the water jacket core support pin 118 until the metal molds are closed, and the water jacket core 122 is fixed at a position by the abutment between the water jacket core 122 and the abutment face 108*a* and by the engagement between the projection 122*a* and the recess 109*a*, so that the water jacket core 122 is positioned around the sleeve at the time of closure of the metal molds, Accordingly, it would be difficult to stably position the water jacket core 122 at a given position.

Further, since gas in the water jacket core 12 and the cavity has a nature of moving upwardly, thickness of the casted cylinder block at its upper portion is likely to be non-uniform by the elevating gas due to the horizontal orientation of the casted cylinder block. Gas defects such as misrun, cold shut and blow hole is likely to occur. Moreover, if boss portion is provided at an upper portion of the cavity, gas accumulation may occur at the boss portion. Furthermore, since the cylinder block is oriented horizontally, sufficient fluidity of the molten metal may not provided, and horizontal orientation in the solidifying direction results. Thus, non-uniform casting may occur particularly in case of laminar flow casting. Consequently, desirable product may not be obtainable.

SUMMARY OF THE INVENTION

The present invention has been made in view of the above described drawbacks, and it is an object of the present invention to provide a metal mold arrangement for casting water-cooled type cylinder block in a horizontal type casting machine, the metal mold being capable of facilitating insertion of the water jacket core with sufficient fluidity and without gas defect.

These and other objects of the present invention will be attained by providing an improved metal mold arrangement used in a horizontal type casting device for casting a water-cooled type cylinder block having a cylinder bore portion provided with a cylinder liner, a water jacket portion surrounding the cylinder bore portion and a crank chamber portion. The metal mold arrangement includes a stationary platen, a stationary die fixed to the stationary platen, a movable platen movable toward the stationary die, a movable die fixed to the movable platen, and a movable core movable between the stationary and movable dies. The stationary die, the movable die, and the movable core define a contour of the cylinder block. The stationary die, the movable die and the movable core define a cavity having a shape corresponding to that of the cylinder block. The cavity has a vertical orientation in which the cylinder bore portion is positioned upwardly and the crank chamber portion is positioned downwardly. A movable slide core is further provided which is slidable with respect to the movable die and movable between forward and retract positions. A water jacket core can be positioned around the movable core for forming the water jacket portion. The water jacket portion has an upper portion provided with a hanger portion for suspending the water jacket core from the movable core.

In the metal mold arrangement for casting the water-cooled type cylinder block in the horizontal type casting device according to the present invention, the stationary die, the movable die and the movable slide core define a vertically oriented cavity for the water cooled type cylinder block, in which the cylinder bore portion surrounded by the water jacket is positioned up and the crank chamber is positioned down. Because of the vertical orientation, the water jacket core can be placed upon the movable core. Therefore, the water jacket core can be held in a position by suspending the water jacket core from the movable core at the hanger portion. For vertically orienting the water-cooled type cylinder block in the horizontal type casting device, large working space is required when setting the water jacket core. In the present invention, large working space can be provided by the retraction of the movable slide core.

DETAILED DESCRIPTION OF THE PREFERRED EMBODIMENTS

Figure 8:
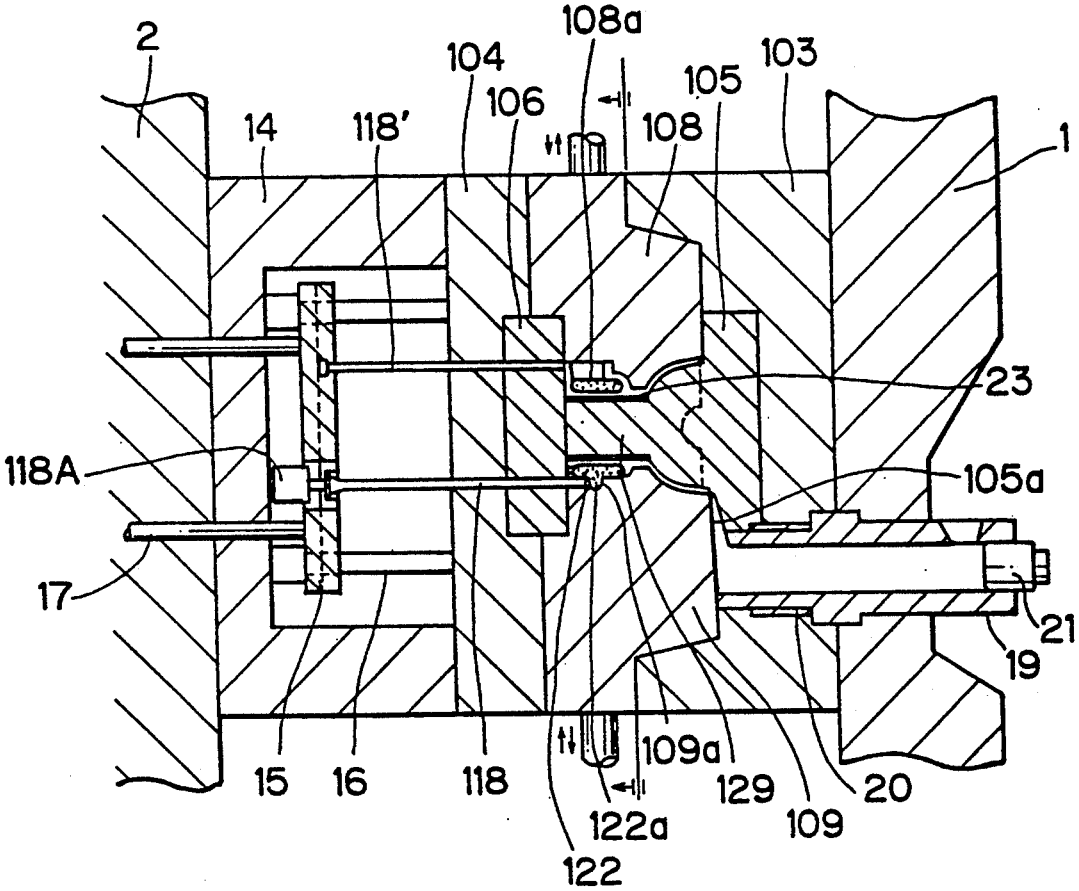
FIG. 8 PRIOR ART
FIG. 8 is a cross-sectional view showing a conventional casting device for casting a water-cooled type cylinder block.
Figure 9:
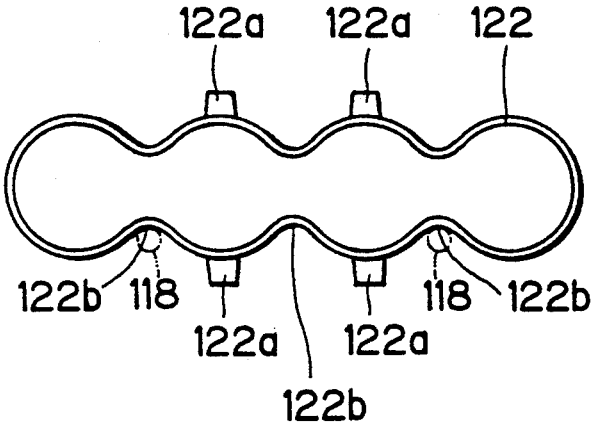
FIG. 9 is a front view showing a state where a water jacket core is set on a water jacket core support pin in the conventional water-cooled type cylinder block casting device.

A metal mold arrangement for casting a water-cooled type cylinder block according to a first embodiment of the present invention will be described with reference to FIGS. 1 through 5. The first embodiment pertains to a metal mold arrangement for casting a cylinder block of a multi-cylinder in-line engine. In the drawings, like parts and components are designated by the same reference numerals as those shown in FIG. 8.

The illustrated embodiment is applied to the horizontal type casting machine similar to the conventional casting machine for casting the water-cooled type cylinder block. Similar to the conventional casting machine, a stationary die 3 is fixed to a stationary platen 1, and a movable die 4 is fixed to a movable platen 2 through a die base 14 in confronting relation to the stationary die 3. A stationary die 5 is disposed in the stationary die 3, and an injection sleeve 19 extends through the stationary platen 1 and the stationary die 3. A bushing 20 is disposed over a portion of the injection sleeve 19, the portion being positioned at a side of the stationary die 5. A plunger chip 21 is slidably disposed in the injection sleeve 19. These arrangements are similar to the conventional horizontal casting machine. However, in the illustrated embodiment, a cylinder block is molded in its vertical orientation, which is quite different from the conventional metal mold arrangement for casting the water-cooled type cylinder block.

To this effect, the stationary die 5 of the present embodiment defines each half outer contour of an upper cylinder bore portion and a lower crank chamber. On the other hand, in the movable die 4, a movable die 6 having a hole portion **6*a* is disposed. Further, a movable slide core 7 is slidably disposed in the hole portion 6*a*. One end faces of the movable die 6 and the movable slide core 7** define each remaining half outer contour of the upper cylinder bore portion and the lower crank chamber. Furthermore, the one end of the movable slide core 7 has an abutment face 7*a* abuttable on a water jacket core 22 described later.

Another end face of the movable slide core 7 is integrally connected to a piston rod 13*a* of a hydraulic cylinder 13 disposed in the movable die 4, so that the movable slide core 7 is slidably movable toward and away from the stationary die in accordance with the operation of the hydraulic cylinder 13. Further, guide rods 16 are disposed in a die base 14 fixed to the movable platen 2, and ejector plate 15 is disposed movable along the guide rods 16. The ejector plate 15 fixes each one end of a plurality of push-out pins 18 each extending through the movable die 4 and the movable slide core 7. Each tip end of the push-out pins 18 can extend from and retract into the one end of the movable slide core 7 for separating a casted project from the movable slide core 7 when the metal molds open as described later. Incidentally, the ejector plate 15 is connected to push rods 17 coupled to a drive means (not shown).

Upwardly movable core 8 and downwardly movable core 9 are disposed between the stationary die 5 and the movable die 6. A part of an outer surface of the downwardly movable core 9 confronts the injection sleeve 19, and a gate 26 and a gate runner 26*a* are defined relative to the stationary die 5. Further, the downwardly movable core 9 integrally provides a vertically extending bore pin 29 which defines an inner surface of the cylinder block. Further, a cast iron sleeve 23 is disposed and supported around the bore pin 29. On the other hand, a lower surface of the upwardly movable core 8 defines an upper surface of the cylinder block and pressingly holds a water jacket core 22 from a position thereabove described later.

In the movable die 4, upper stop member 11 and lower stop member 12 are disposed slidably in a vertical direction. These stop members 11, 12 define a forward position of the movable slide core 7 during casting, and prevent the movable die 4 from being retracted against the casting pressure. Further, for setting the water jacket core 22, these stop members 11, 12 are moved upwardly and downwardly, so that the movable slide core 7 can be moved to its retract position. An upper end of the upper stop member 11 is connected to an upper end portion of the upwardly movable core 8 by means of a linking member 10. A lower end surface of the upwardly movable core 8 is formed with an engagement groove 28 for engaging with a core print.

Figure 4:
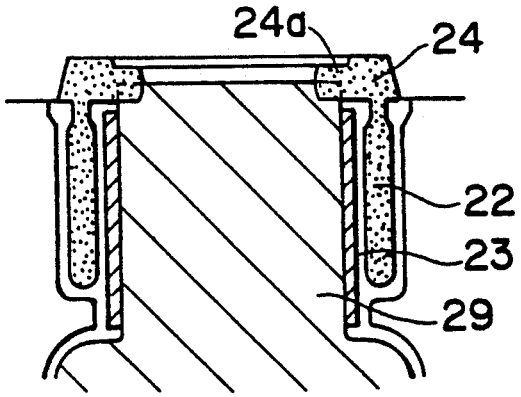
FIG. 4 is a cross-sectional view showing a water jacket core setting state in the metal mold arrangement for casting the water-cooled type cylinder block according to the first embodiment.
Figure 5:
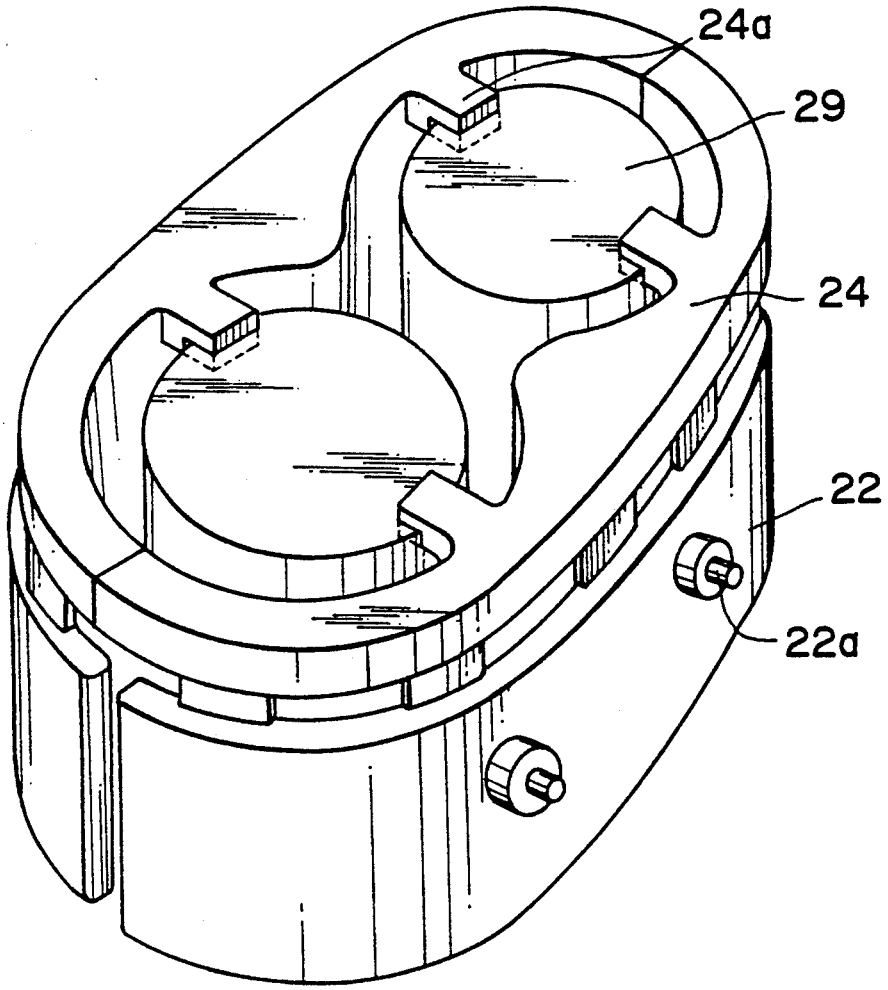
FIG. 5 is a perspective view showing the water jacket core setting state in the metal mold arrangement for casting the water-cooled type cylinder block according to the first embodiment.

As shown in FIGS. 4 and 5, the water jacket core 22 is disposed in vertical orientation at a concentrically outer area of the cast iron sleeve 23 supported by the bore pin 29. An upper portion of the water jacket core 22 integrally provides a core print 24 having a hanger portion 24*a* placeable upon the upper end surfaces of the sleeve 23 and the bore pin 29. The position of the core 22 relative to the sleeve 23 can be set because of own weight of the core 22 when suspending the water jacket core 22. Further, the hanger portion 24 is engageable with the engagement groove 28 when the upwardly pull-out core 8 is moved to its descent position. Further, the water jacket core portion has a protrusion 22*a* extending in a horizontal direction, which is engageable with the recess 5*a* formed in the stationary core 5.

Figure 1:
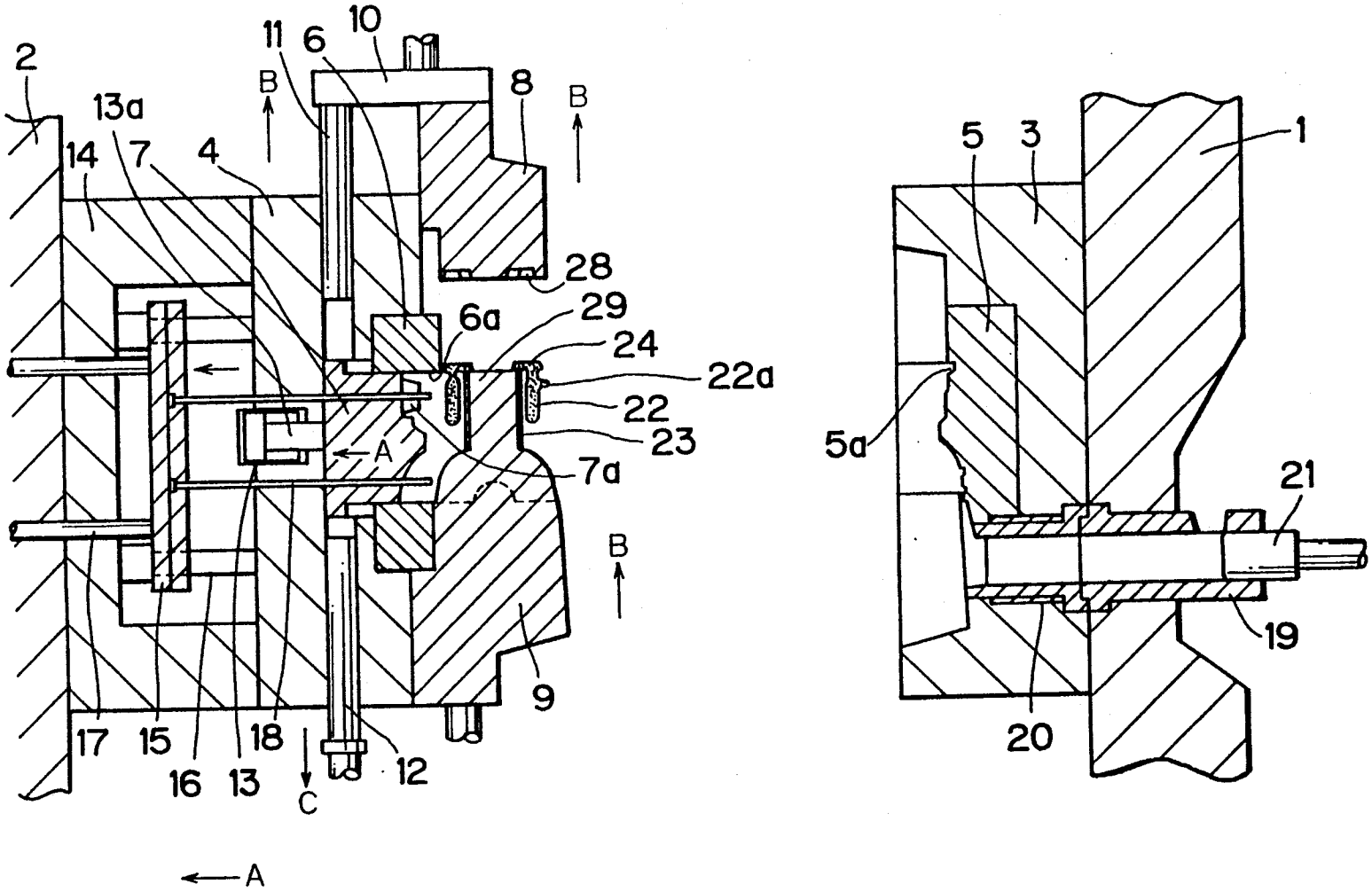
FIG. 1 is a cross-sectional view showing a core setting state of a metal mold arrangement for casting a water-cooled type cylinder block according to a first embodiment of this invention.
Figure 2:
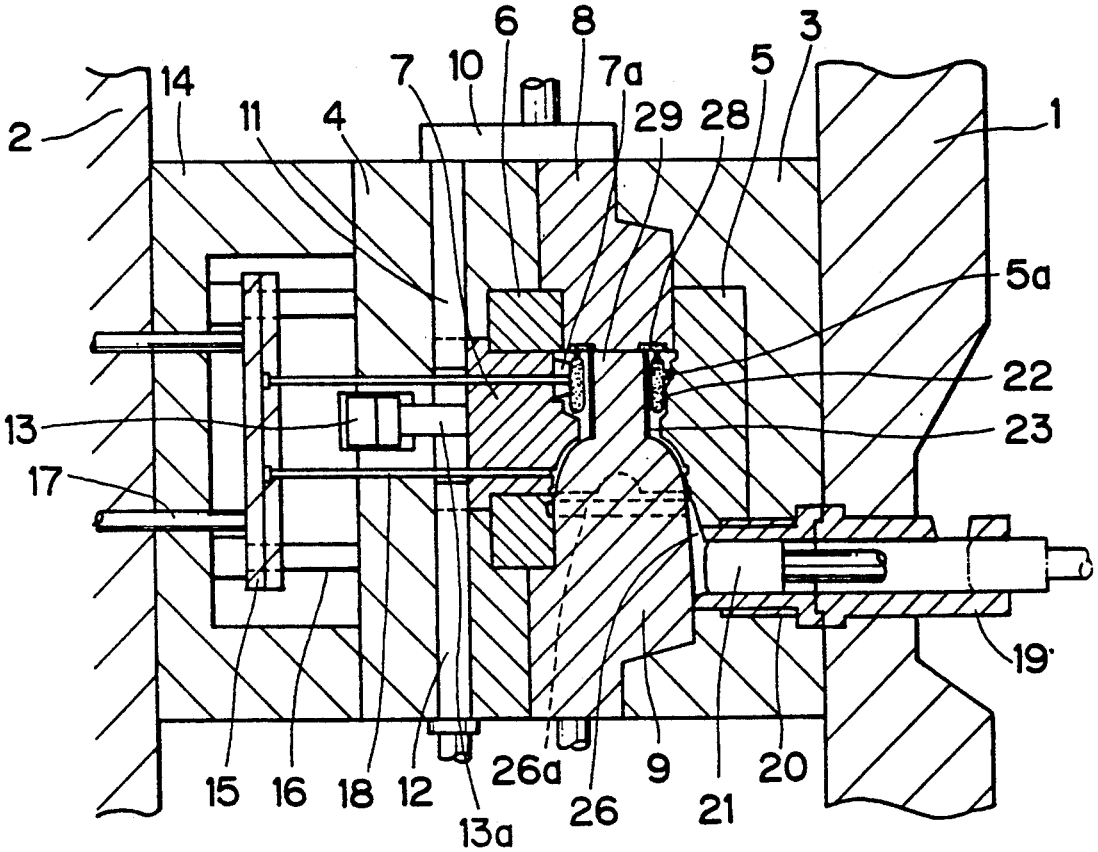
FIG. 2 is a cross-sectional view showing a casting condition in the metal mold arrangement for casting the water-cooled type cylinder block according to the first embodiment.
Figure 3:
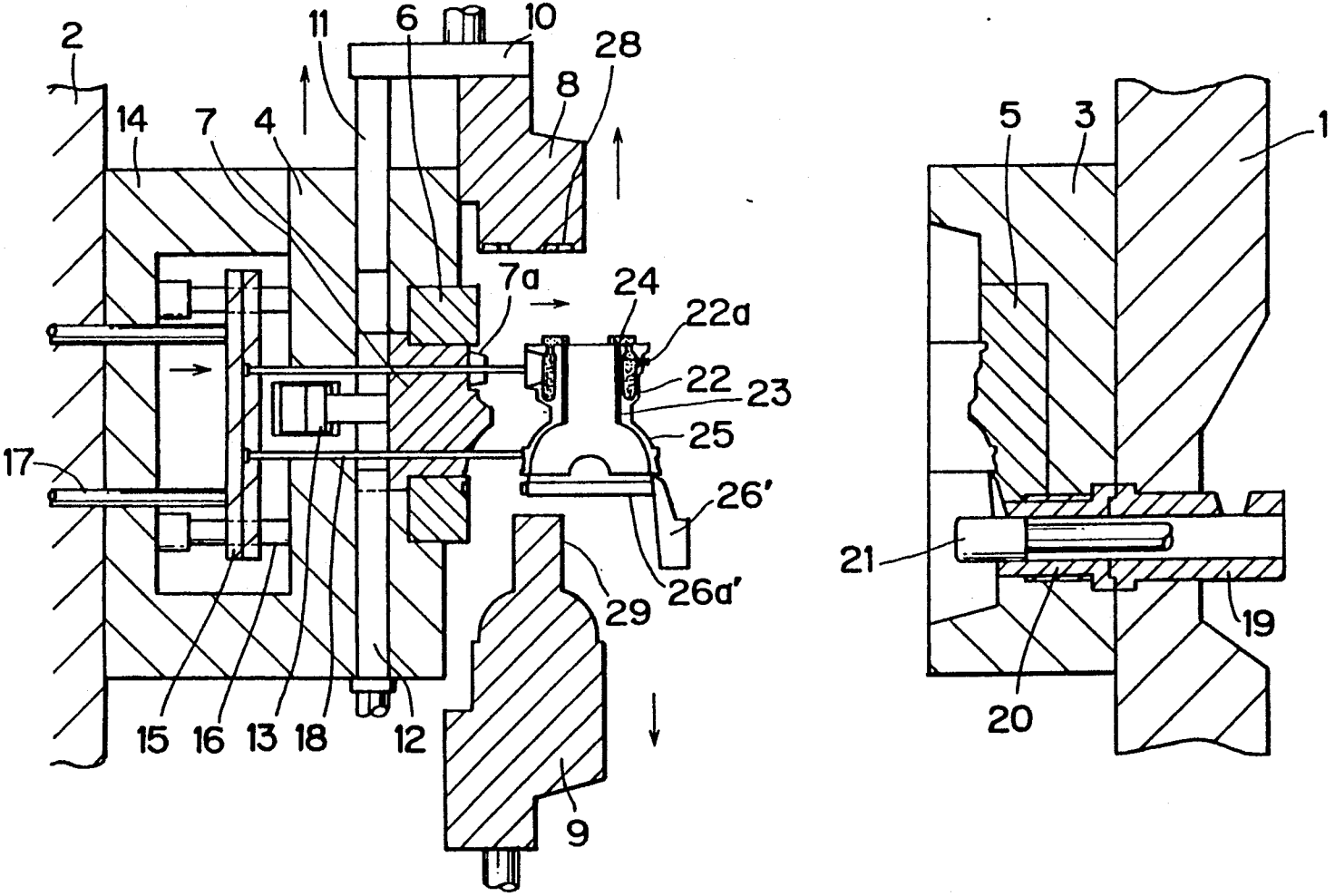
FIG. 3 is a cross-sectional view showing a mold opening state of the metal mold arrangement for casting the water-cooled type cylinder block according to the first embodiment.

With this arrangement, for setting the dies, as shown in FIG. 1, the movable platen 2 is moved in a direction indicated by an arrow A to provide large area between the stationary and movable dies 3 and 4. With this state, the downwardly pull-out core 9 is at its ascent position as indicated by an arrow B, and the lower stop member 12 is moved downwardly as indicated by an arrow C. Further, the movable slide core 7 is retracted in the direction of arrow A by the hydraulic cylinder 13. In this case, since the upper stop member 11 and the lower stop member 12 are moved in the directions B and C, respectively, the other end of the movable slide core 7 can be further retracted without mechanical interference with the ambient stop members. Accordingly, relatively large space can be provided among the bore pin 29 which has its ascent position, the one end face of the retracted movable slide core 7 and the lower end face of the upwardly pull-out core 8. Incidentally, the pull-out plate 15 is at its retracted position, and the tip end of the ejector pin 18 is positioned spaced away from the bore pin 29.

Because of the elevation of the upwardly pull-out core 8 and the retraction of the movable slide core 7, relatively large working space can be provided for setting the water jacket core 22 around the outer periphery of the sleeve 23. With this state, the sleeve 23 is set around the bore pin 29, and as shown in FIG. 5, the hanger portion 24*a* of the core print 24 of the water jacket core 22 is placed upon the upper end face of the bore pin 29 and the water jacket core 22 is subjected to positioning relative to the bore pin 29.

Then, the movable slide core 7 is forwardly moved by the operation of the hydraulic cylinder 13, the upwardly movable core 8 and the upper stop member 11 integrally therewith are moved downwardly, and the lower stop member 12 is moved upwardly. Accordingly, the other end of the movable slide core 7 is brought into abutment with the upper stop member 11 and the lower stop member 12, to thereby define the forward position of the movable slide core 7. Further, by the downward movement of the upwardly movable core 8, the engagement groove 28 formed at the lower surface thereof is brought into engagement with the core print 24.

Next, the movable platen 2 is moved toward the stationary platen 1, so that the projection 22*a* of the water jacket core 22 is brought into engagement with the recessed portion 5*a* of the stationary die 5, and the water jacket portion abuts the abutment surface 7*a* of the movable slide core 7. Thus, the water jacket core 7 is completely clamped to provide the mold setting state shown in FIG. 2. In this state, a combination of the stationary die 5, the movable die 7, the upwardly movable core 8 and the downwardly movable core 9 provides a vertically oriented cavity for casting a water-cooled type cylinder block 25 in a vertical orientation where the cylinder bore portion is positioned upwardly and the crank chamber is positioned downwardly.

With this state, casting is performed in which the plunger chip 21 is moved forwardly to fill the molten metal into the vertically oriented cavity. Thus, insert of the molten metal around the sleeve 23 occurs, and casted product is obtained upon solidification of the molten metal. Thereafter, the movable platen 2 is moved in the direction of arrow A, and the downwardly movable core 9 is moved down-wardly for separating the casted product from the downwardly pull out die 9. Further, the upwardly movable core 8 is moved upwardly for separating from the upper surface of the casted product. Then, the ejector plate 15 is moved toward the stationary die, so that the ejector pin 18 extends toward the stationary die. Thus, the casted cylinder block 25 is separated from the movable die 6 and the movable slide core 7. The surplus molten metal portions 26' and 26a' solidified at the gate 26 and the gate runner 26a are held by a product take-out device (not shown) for completing the take-out of the cylinder block 25.

Figure 6:
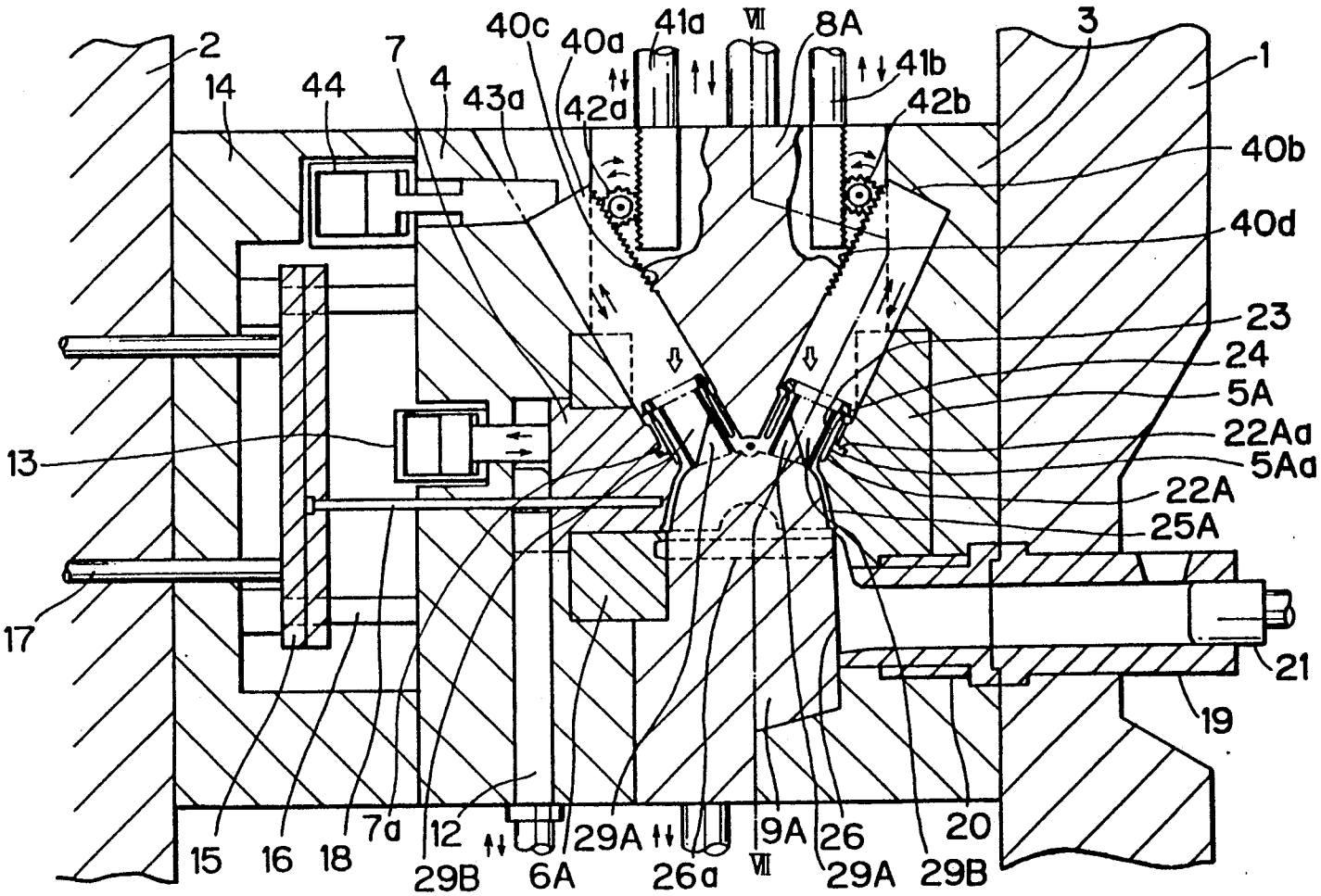
FIG. 6 is a cross-sectional view showing a core setting state of a metal mold arrangement for casting a water-cooled type cylinder block according to a second embodiment of this invention.
Figure 7:
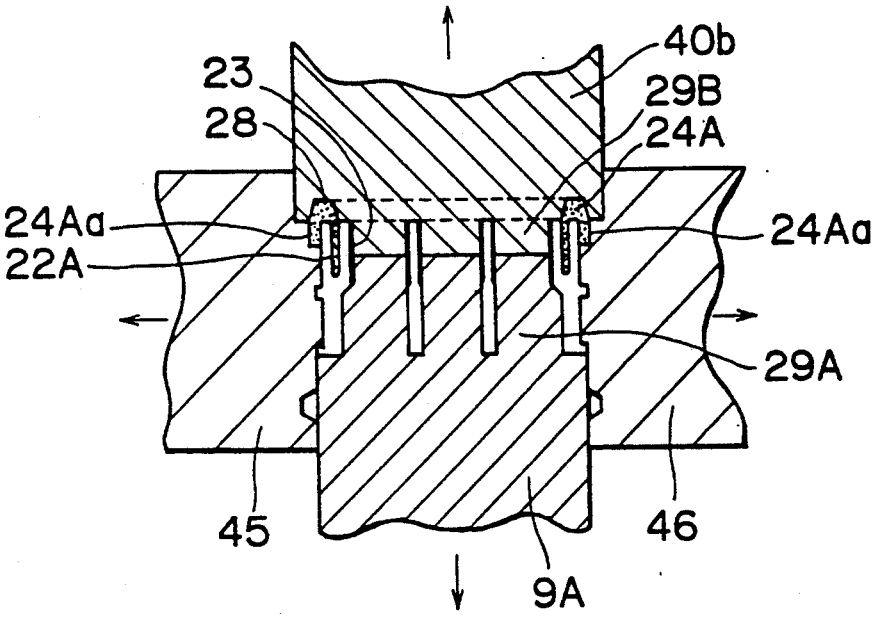
FIG. 7 is a cross-sectional view taken along a line VII—VII showing the core setting state of a metal mold arrangement for casting the water-cooled type cylinder block according to the second embodiment.

A metal mold arrangement in a horizontal type casting machine for casting a water-cooled type cylinder block according to a second embodiment of the present invention will be described with reference to FIGS. 6 and 7. The second embodiment pertains to the casting machine for casting a cylinder block of a V-type multi-cylinder engine such as a V-six cylinder engine. In FIGS. 6 and 7, like parts and components are designated by the same reference numerals as those shown in FIGS. 1 through 5 for avoiding duplicating description.

An upper portion of the downwardly movable core 9A has two rows of (each row having three bores) lower bore pins 29A, 29A extending upwardly and integrally therewith for defining a part of the cylinder bore of the V-type cylinder block 25A. Top surfaces of the bore pins 29A, 29A are slanted obliquely with respect to an axis of the cylinder bore. When two rows of upper bore pins described later is brought into abutment with the lower bore pins, entire inner peripheral contour of the cylinder bores is defined. To be more specific, the oblique upper surfaces of the lower bore pins 29A, 29A are configured such that an area of cylindrical portion at the V-bank side is greater than an area of the remaining cylindrical portion at a side opposite the V-bank. The cylindrical portions at the V-bank side of the lower bore pins serve as guide surfaces in the orientation of V bank when the sleeve 23 and the water jacket core 22A are to be disposed around the lower bore pins 29A, 29A.

The upwardly movable core 8A has a lower portion which defines an outer surface configuration of the V-bank portion of the V-type cylinder block. Further, two rows of bore slide dies 40a, 40b (each row having three dies) are disposed movably with respect to the upwardly pull out die 8A. The bore slide dies 40a, 40b are arranged in V-shape, whose upper portions have toothed surfaces 40c, 40d. A pair of racks 41a, 41b are vertically movably disposed in the upwardly movable core 8A and are driven by drive means (not shown). Further, in the upwardly movable core 8, there are provided rotatable pinions 42a, 42b meshedly engageable with the racks 41a, 41b. These pinions 42a, 42b are also meshedly engageable with the toothed surfaces 40c, 40d. Thus, by the vertical motion of the racks 41a, 41b, the pinions 42a, 42b are rotated for moving the bore slide dies 40a, 40b in their axial directions.

The bore slide dies 40a, 40b have their lower portions provided with upper bore pins 29B, 29B integrally therewith and extending coaxially with the lower bore pins 29A, 29A. Lower surfaces of the upper bore pins 29B, 29B extends obliquely relative to the axis of the bore pins. When the lower slant surfaces of the upper bore pins 29B, 29B are brought into abutment with the upper slant surfaces of the lower bore pins 29A, 29A, the cylinder bore portions of the V-type cylinder block is defined by the combination of the upper and lower bore pins 29A and 29B. Cast iron sleeves 23 serving as cylinder liners are disposed around the upper and lower bore pins 29A, 29B. Further, a stop member 43a is disposed abuttable on an upper surface of the bore slide core 40a in order to fix the setting position of the bore slide core 40a. The stop member 43a is connected to a hydraulic cylinder 44 disposed in a die base 14 for moving toward and away from the upper surface of the bore slide core 40a.

In the illustrated embodiment, a part of the stationary die 5A and the movable die 6A are cut away for disposing the bore slide dies 40a, 40b so as to provide V-shape arrangement of the V-type cylinder block. Similar to the first embodiment, the movable slide core 7 is disposed movably in the movable die 6A. When the movable slide core 7 is moved to its forward position, the slide core 7 has a casting position for defining half of the outer contour of the upper cylinder bore portion and half of the outer contour of the lower crank chamber. On the other hand, a retract position of the movable slide core 7 provides large working space for setting the water jacket core.

As shown in FIG. 7, a front movable core 45 and a rear movable core 46 are movably disposed at positions corresponding to the stationary die 5A and the movable die 6A, but are movable in the direction perpendicular to the moving direction of the movable die 6A. These front and rear movable cores 45, 46 define front and rear contours of the V-type cylinder block, and are adapted to support hanger portion 24Aa of a core print 24A provided integrally with the water jacket core 22A. In FIG. 7, tree cylinders arranged in one of the rows of the V-type cylinders are shown. One water jacket core 22A is arranged for the three cylinders and has front and rear end portions provided with the hanger portions 24Aa, one hanger portion being mounted on the front movable core 45, and the other hanger portion being mounted on the rear movable core 46.

With this structure, for setting each of the dies, the movable platen 2 is moved to its open position, so that the movable die 4 is moved away from the stationary die 3. Thus, locking state of the upwardly movable core 8A, the downwardly movable core 9A and the bore slide core 40b is released. Then, the hydraulic cylinder 4 is actuated for retracting the stop member 43a, so that the stop member 43a is disengaged from the bore slide core 40a. Next, the racks 41a, 41b are moved in the vertical direction for rotating the pinions 42a, 42b, so that the bore slide dies 40a, 40b are axially moved upwardly. Thus, the bore slide dies are separated from the upwardly movable core 8A. Thereafter, the upwardly movable core 8A is moved upwardly. Further, the stop member 12 is pulled downwardly for unclamping the movable slide core 7. Then, the hydraulic cylinder 13 is actuated for retracting the movable slide core 7. By the downward displacement of the stop member 12, the other end of the movable slide core 7 does not interfere with the stop member 12, so that the movable slide core 7 can further be retracted. Accordingly, relatively large space can be provided among the bore pins 29A at their upper positions, one end face of the retracted movable slide core 7 and the lower end face of the upwardly movable core 8. Consequently, the water jacket core 22A can be subsequently set easily in the large working space.

Next, the sleeves 23 are disposed around the lower bore pins 29A, 29A. In this case, because of the surface orientations of the lower bore pins 29A, 29A, the sleeves 23 can be oriented in the V-direction. Then, a pair of (right and left) water jacket cores 22A are disposed around the sleeves 23. The disposition of the water jacket cores 22A, 22A is facilitated by placing the hanger portions 24Aa extending from the core print 24A upon the front and rear movable cores 45, 46. In this case, as described above, since the two rows of the lower bore pins 29A, 29A have slant upper surfaces in such a manner that surface areas at the V-bank side of the lower bore pins 29A, 29A is greater than the remaining surface areas, the lower bore pins can serve as guide surfaces in the V-direction. Thus, the water jacket core mounted on the front and rear movable cores 45, 46 can be oriented in the V-shape fashion along the profile of the lower bore pins 29A, 29A, even prior to the downward movement of the upper bore pins 29B. Incidentally, the water jacket core 22A can be automatically disposed by means of a robot (not shown), since the water jacket core 22A can be installed with a simple operation, such that the water jacket can be installed around the lower bore pins from the above.

Next, the hydraulic cylinder 13 is actuated for advancing the movable slide core 7. Further, the lower stop member 12 is moved upwardly. Therefore, the other end of the movable slide core 7 abuts the lower stop member 12 for defining the forward position of the movable slide core 7. Then, the upwardly movable core 8A is moved downwardly to its predetermined position. The bore slide dies 40*a*, 40*b* are moved downwardly by the operation of the racks 41*a*, 41*b*, so that the upper bore pins 29B, 29B are brought into abutment with the lower bore pins 29A, 29A. Thus, the sleeves 23 and the water jacket cores 22A are set in their given positions.

Then, the movable platen 2 is moved toward the stationary platen 1. Projection 22Aa of the water jacket core 22A is brought into engagement with a recessed portion 5Aa of the stationary die 5A and the parting face 7*a* of the movable slide core 7. As a result, the water jacket core 22A is completely clamped to thus provide mold setting state shown in FIG. 7. Subsequent casting and the metal mold opening are similar to those performed in the first embodiment, and further description can be negligible.

In the metal mold arrangement for casting water cooled type cylinder block with using a horizontal type casting machine, the following advantages can be provided:

(1) Setting of the water jacket core can be easily achieved even in the horizontal type casting machine, since the movable slide core is largely retracted from the core setting space when the water jacket core is to be set in the vertical orientation.

(2) The water jacket core can be set easily at a predetermined position in its suspended manner, since the cylinder block is molded in its vertical orientation.

(3) Gas venting from the water jacket core can be achieved through the upper core print, and therefore, the casted product undergoes minimum influence on the gas defect.

(4) Gas around the cast iron sleeve, which functions as the cylinder liner, flows vertically, and therefore, sufficient insertion or casting around the sleeve can be provided, thereby ensuring tight connection between the sleeve and the filled metal.

(5) Since the cylinder block is set in the vertical direction, the molten metal flows in the axial direction of the cylinder. Therefore, sufficient fluidity of the molten metal results, and gas accumulation within the cavity can be restrained. Further, since the molten metal is solidified in the axial direction of the cylinder, uniform casting is provided with respect to the circular cross sectional shape of the cylinder.

While the invention has been described in detail and with reference to specific embodiments thereof, it would be apparent to those skilled in the art that various changes and modifications may be made therein without departing from the spirit and scope of the invention.

What is claimed is:

1. A metal mold arrangement used in a horizontal type casting device for casting a water-cooled type cylinder block having a cylinder bore portion provided with a cylinder liner, a water jacket portion surrounding the cylinder bore portion and a crank chamber portion, the metal mold arrangement including a stationary platen, a stationary die fixed to the stationary platen, a movable platen movable toward the stationary die, a movable die fixed to the movable platen, a movable core movable between the stationary and movable dies, the stationary die, the movable die, and the movable core defining a contour of the cylinder block, and the improvement comprising:

the stationary die, the movable die and the movable core defining a cavity having a shape corresponding to that of the cylinder block, the cavity having a vertical orientation in which the cylinder bore portion is positioned upwardly and the crank chamber portion is positioned downwardly;

a movable slide core slidable with respect to the movable die and movable between forward and retract positions; and a water jacket core settable around the movable core for forming the water jacket portion, the water jacket portion having an upper portion provided with a hanger portion for suspending the water jacket core from the movable core.

2. The metal mold arrangement as claimed in claim 1, further comprising a drive means provided at the movable die and connected to the movable slide core for moving the movable slide core between the forward and retract positions.

3. The metal mold arrangement as claimed in claim 2, wherein the hanger portion is placeable upon an upper surface of the movable core for suspending the water jacket core from the movable core.

4. The metal mold arrangement as claimed in claim 3, wherein the movable core comprises:

a downwardly movable core movable in a vertical direction and having an upper portion provided with a bore pin extending vertically, the cylinder liner being disposed around the bore pin and the water jacket core being positioned concentrically around the cylinder liner and placeable upon the bore pin through the hanger portion; and an upwardly movable core movable in a vertical direction and having a lower surface portion abuttable on the water jacket core.

5. The metal mold arrangement as claimed in claim 4, wherein the movable slide core is positioned confrontable with the downwardly movable core for defining a half of an outer contour of the upper cylinder bore portion and a half of an outer contour of the lower crank chamber portion, and wherein the stationary die comprises a stationary die positioned confrontable with the downwardly movable core for defining a remaining half of an outer contour of the upper cylinder bore portion and a remaining half of an outer contour of the lower crank chamber portion.

6. The metal mold arrangement as claimed in claim 5, wherein the water jacket core has a projection, and wherein the stationary die is formed with an engagement recess engageable with the projection.

7. The metal mold arrangement as claimed in claim 6, wherein the lower surface portion of the upwardly movable core is formed with an engagement groove, and wherein the upper portion of the water jacket core has a core print from which the hanger portion extends, the core print being engageable with the engagement groove.

8. The metal mold arrangement as claimed in claim 7, further comprising: an ejector pin provided movable relative to the movable platen and extendible toward and retractable from the cavity for separating a cast cylinder block from the movable die.

9. The metal mold arrangement as claimed in claim 8, wherein the cylinder block comprises a block for a multi-cylinder in-line internal combustion engine.

10. The metal mold arrangement as claimed in claim 2, wherein the movable core comprises:

a downwardly movable core movable in a vertical direction and having an upper portion provided with two rows of lower bore pins, the rows defining a V-shape in combination, a plurality of the cylinder liners being disposable around the lower bore pins; and an upwardly movable core movable in a vertical direction and confrontable with the downwardly movable core.

11. The metal mold arrangement as claimed in claim 10, wherein the upwardly pull out die comprises;

a main portion whose lower portion has a shape corresponding to a V-bank shape defined by the V-shape created by the two rows of the lower bore pins; and two rows of bore slide dies slidably disposed in the main portion, each of the bore slide dies having a lower portion provided with an upper bore pin extending coaxial with the lower bore pins, a combination of each upper and lower bore pins defining one cylinder bore of the cylinder block, and the plurality of the cylinder liners being disposed around each combination of the upper and the lower bore pins.

12. The metal mold arrangement as claimed in claim 11, wherein each of the lower bore pins has a top surface extending obliquely with respect to an axis of the lower bore pin, such that an area of a half cylindrical surface at the V-bank side is greater than an area of a remaining half cylindrical surface at a side opposite the V-bank, whereby the cylinder liner can be disposable around the lower bore pin without the upper bore pin.

13. The metal mold arrangement as claimed in claim 12, wherein each of the upper bore pins has a bottom surface extending obliquely with respect to an axis of the upper bore pin for mating contact with the top surface of the lower bore pin and for providing coaxial relation between the upper and lower bore pins.

14. The metal mold arrangement as claimed in claim 13, wherein the movable core further comprises:

a front movable core movable at a position in front of the upper and lower bore pins; and a rear movable core movable at a position rearward of the upper and lower bore pins, the hanger portion being placeable on the front and rear movable cores.

15. The metal mold arrangement as claimed in claim 14, wherein the cylinder block comprises a block for a V-type multi-cylinder internal combustion engine.

* * * * *